United States Patent [19]

Schröder et al.

[11] 4,355,705

[45] Oct. 26, 1982

[54] GROUP CONTROL FOR ELEVATORS

[75] Inventors: Joris Schröder, Lucerne; Hans Bosshard, Würenlos; Jiri Kiml; Miroslav Kostka, both of Ebikon; Walter Zimmermann, Buochs, all of Switzerland

[73] Assignee: Inventio AG, Hergiswil, Switzerland

[21] Appl. No.: 210,007

[22] Filed: Nov. 24, 1980

[30] Foreign Application Priority Data

Dec. 21, 1979 [CH] Switzerland ..... 11396/79

[51] Int. Cl.[3] ..... B66B 1/18

[52] U.S. Cl. ..... 187/29 R

[58] Field of Search ..... 187/29

[56] References Cited

U.S. PATENT DOCUMENTS

| | | | |
|---|---|---|---|
| 3,739,880 | 6/1973 | Robaszkiewicz | 187/29 |
| 4,030,571 | 6/1977 | Kaneko et al. | 187/29 |
| 4,081,059 | 3/1978 | Kuzunuki et al. | 187/29 |
| 4,149,613 | 4/1979 | Yoneda et al. | 187/29 |

*Primary Examiner*—J. V. Truhe
*Assistant Examiner*—W. E. Duncanson, Jr.
*Attorney, Agent, or Firm*—Werner W. Kleeman

[57] ABSTRACT

With this group control the allocation of elevator cabins or cars to existing storey or floor calls should be time-wise optimized and newly arriving storey calls should be immediately allocated. A computer device provided for each elevator computates at each landing or storey, irrespective of whether or not there is present a storey or landing call, from the distance between the storey and the cabin position indicated by a selector, the intermediate cabin stops to be expected within this distance and the momentary cabin load a sum proportional to the time losses of waiting passengers. In this way the cabin load prevailing at the computation time point is corrected such that the expected number of passengers entering and exiting the cabin, derived from the previously ascertained number of entering and exiting passengers is taken into account for the future intermediate cabin stops. Such loss time sum, also referred to as the servicing cost, is stored in a cost storage or memory provided for each elevator. During a cost comparison cycle the servicing costs of all elevators are compared with one another by means of a comparator, and in an allocation storage of the elevator with the lowest servicing cost there can be stored an allocation instruction which designates that storey or floor to which there can be optimumly allocated the relevant elevator cabin.

16 Claims, 5 Drawing Figures

GROUP CONTROL FOR ELEVATORS

BACKGROUND OF THE INVENTION

The present invention relates to a new and improved construction of a group control for elevators or the like.

Generally speaking, the group control for elevators or the like according to the invention comprises at least one storey call storage which can be controlled by means of storey call transmitters, cabin call storages correlated to each cabin of the group and which can be controlled by means of cabin call transmitters. Further, there are provided selectors correlated to each elevator of the group which indicate that storey at which the cabin still could stop, and load measuring devices correlated to each cabin as well as a scanner device for each storey which possesses at least one position. Each elevator is provided with a computer device possessing an adder, the computer device forming from at least the distance between a considered storey and the selector position, the number of intermediate stops to be expected within such distance predicated upon existing cabin and allocated storey calls as well as the momentary cabin load a time proportional sum corresponding to the service capability of a cabin of the group with respect to the considered storey. At least one comparison device or comparator is provided by means of which the cabin having the lowest servicing cost corresponding to the smallest previously computated loss time and therefore optimum service capability can be allocated to the considered storey or floor.

With such type control as has been disclosed in U.S. Pat. No. 3,511,342 a call determining device possessing a ring counter brings the storey calls contained in the storey call storage or memory into a sequence in which they can be successively allocated by means of a call distributor to the individual cabins of an elevator group. The call distributor examines all of the cabins at the same time and selects that cabin which possesses an optimum servicing or employing capability for the related call, wherein the servicing capability is expressed by a time-proportional signal dependent upon a number of factors. The call distributor contains a finder, for instance in the form of a further ring counter which possesses the finding or seeking positions corresponding to the storey calls. Upon presence of a call selected by the call determining device the finder is placed into operation starting from the related storey, and the storey is found in steps. Upon coincidence of the finder and cabin position there is stored in a distance register a number corresponding to the spacing between the call site and the cabin, and there is taken into account whether one is concerned with a travel direction command or a free cabin. The determined number is converted into an analogue signal, corresponding to the time needed by the cabin for the relevant distance. This signal is infed to a summation circuit which determines the servicing capability of the cabin.

During the searching or finding operation up to the cabin there is determined by means of coincidence of the finder position and the storey for which there has been stored the storey call or cabin call, the number of intermediate stops and accumulated in an intermediate stop counter. The counter converts this number into an analogue time signal, which likewise is infed to the summation circuit. In the same manner during the complete finding cycle there is determined the total number of stops and there is infed an appropriate analogue time signal at the end of the finding operation to the summation circuit. In a load determination device there is produced a fourth time signal proportional to the cabin load and likewise fed into the summation circuit.

The output signal of the summation circuit which is formed from the existing four signals is infed to a comparison element. A ramp signal which is generated at the end of the searching or finding operation by a ramp signal generator and which increases with time likewise is infed to the comparison element. Upon coincidence of the signals of a comparison element of a cabin there is accomplished the allocation by storing the selected storey call in a requirement storage correlated to the cabin, and in each case there is strived for the coincidence at the cabin with the smallest time-proportional output signal of the summation circuit and therefore optimum cabin servicing or employment capability.

If the selected storey call is not serviced during a time span controlled by a call time measuring device, then it is extinguished in the requirement storage of the relevant cabin and for the purpose of new allocation is infed to the call determining device and from such to the call distributor.

With the previous group control there are determined for the computation of the time loss of a passenger waiting at the considered storey or floor the time losses caused by the travel time of the cabin and the intermediate stops. The time losses of the travelling quests within the elevator cabin, arising due to stop at such storey, however are only insufficiently taken into account, since the cabin load which no longer exists at the servicing time point owing to possible future entering and exiting passengers and determined at the computation time point are basically incorporated into the time loss computation. With these factors it is only possible with extreme difficulty to optimize the call allocation, because the future arising load changes during progressive approach of the cabin at the considered storey due to the exiting and entering passengers is not determined during the computation during the loss times. Furthermore, it is disadvantageous that the storey calls are only then first allocated when they are infed to the call distributor in accordance with the sequence determined by the call distributor and to be performed according to the computation, so that there can arise delays in the allocation.

SUMMARY OF THE INVENTION

It is a primary object of the present invention to provide a group control for elevators which is not associated with the aforementioned drawbacks and limitations of the prior art proposals.

Another and more specific object of the present invention aims at providing a group control for elevators which is improved upon in relation to those previously described, wherein there is improved upon the optimizing of the allocation of the cabins to the considered storey calls and arriving storey calls are immediately allocated.

Now in order to implement these and still further objects of the invention, which will become more readily apparent as the description proceeds, the group control for elevators as contemplated by the present development is manifested by the features that during the computation of the loss times, referred to hereinafter as the internal servicing costs $K_I$, arising upon stop of the elevator cabin or car at the considered called storey or landing for the passengers or guests in the elevator cabin, there is determined the number of probable passengers which are present in the elevator cabin during such cabin stop by upwardly counting from the momentary load present at the considered time point. In this way there is basically determined for the intermediate stops at storey calls an estimated or approximated number of entering passengers, which can be statistically derived from the number of passengers which in the past entered the elevator cabin. For the intermediate stops at cabin calls there is assumed a number of departing or exiting passengers which is computated from the momentary cabin load divided by the number of cabin calls present for the cabin. Furthermore, during the computation of the loss times prevailing for the passengers waiting at the called storey or landing, hereinafter referred to as the outer or external servicing costs $K_A$, there is additionally taken into account the operating state of the cabin or car and the estimated number of entering passengers. The immediate allocation of the arriving storey calls is attained in that the total servicing costs $K_M=K_I=K_A$ consisting of the inner or internal servicing costs $K_I$ and the outer or external servicing costs $K_A$, of a cabin M is computed for each storey, irrespective of whether or not there is present a storey call. The lowest servicing costs determined by comparison and designating the optimum employment or assignment capability of the elevator cabin are stored, and after a new computation cycle of the same storey based upon a new comparison result there can be allocated a different cabin.

The advantages which can be realized with the invention essentially reside in the fact that due to more exact determination of the total servicing costs there can be accomplished an improved optimization of the allocation of the cabin and storey calls, and the total transport time of all passengers consisting of the travel time and the residence times within and externally of the cabin can be minimized and there can be realized an increased conveying capacity of the elevator group. Furthermore, the prior computation of the momentarily optimum employable cabin for each storey, irrespective whether or not a storey call is present, and storage of the corresponding allocation contributes to avoiding further loss times, since an arriving storey call immediately can be allocated.

A further advantage resides in the fact that after a change of the servicing costs $K_N$, brought about by changing traffic conditions and determined by an immediate new computation and the subsequent cost comparison there can be accomplished a new allocation of the cabin-storey call, and with progressive approach of the cabin at the considered storey there is available more exact data during the servicing cost computation. An additional advantage which can be realized with the invention resides in that the internal servicing costs $K_I$, determined by upward computation, can be used for the proper recognition of the traffic saturation of the elevator group. This saturation is characterized by the fact that the presumable or expected loads of all cabins corresponding to the internal servicing costs $K_I$, when stopping at the considered storey, would exceed a threshold value or limit, so that a storey call present at that location would not be serviced. The inventive group control is conceived such that it does not possess any central section, so that as a further advantage there can be realized reliable functioning and cost savings.

BRIEF DESCRIPTION OF THE DRAWINGS

FIG. 1 is a block circuit diagram of the inventive group control for an elevator group composed of three elevators or the like.

DETAILED DESCRIPTION OF THE PREFERRED EMBODIMENTS

Figure 1:
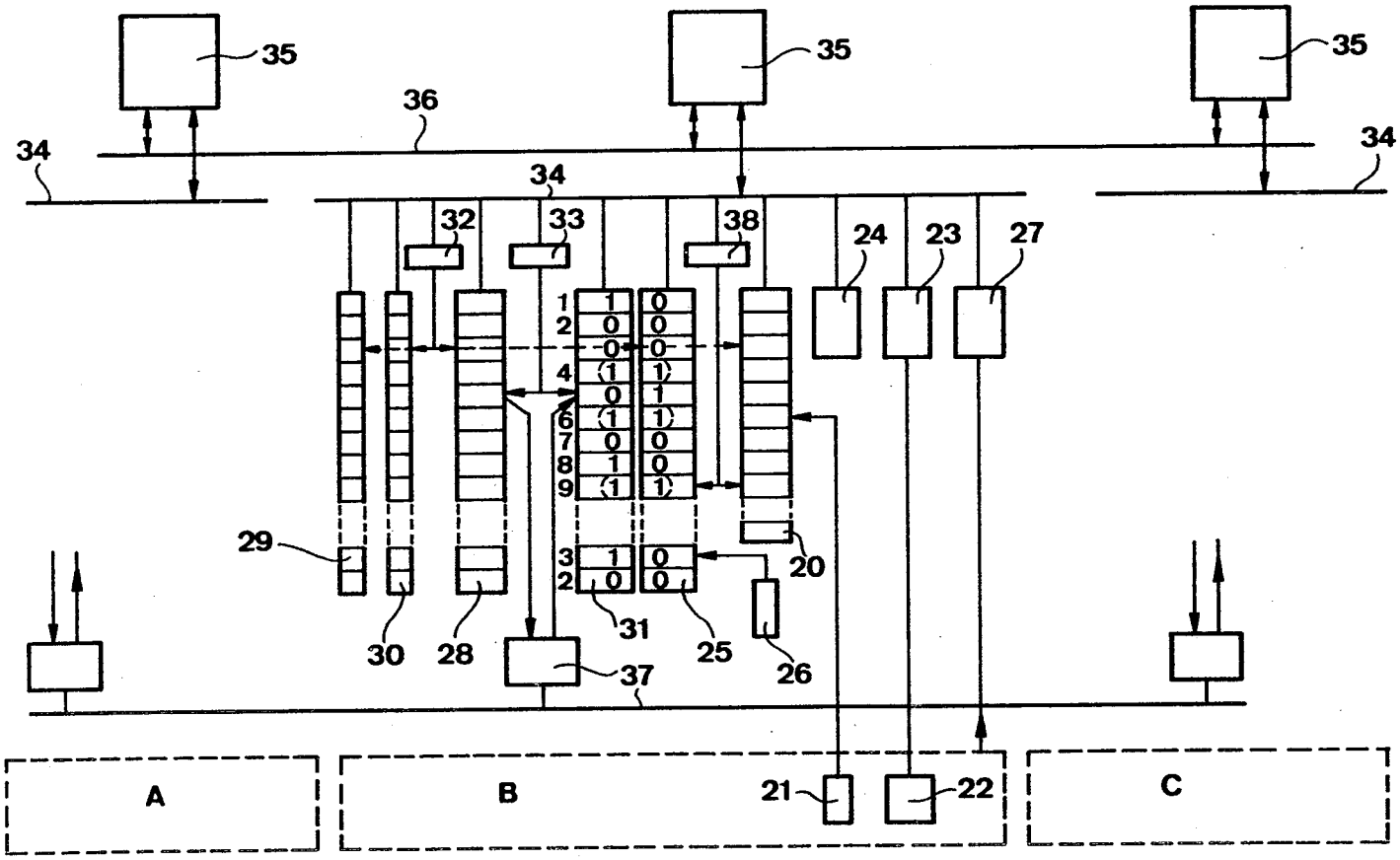

Describing now the drawings, in FIG. 1 reference characters A, B and C designate the elevator cabins of an elevator group composed of the three elevators, wherein each cabin of the group possesses a cabin call storage 20 which can be controlled by means of a cabin call transmitter 21, a load measuring device 22, a load stoage 23 operatively connected with the load measuring device and which stores the momentary cabin load $P_M$, and a device 24 which stores the number $R_C'$ of all cabin calls located in the direction of travel of the cabin. Each elevator of the group has operatively associated therewith a storey call storage or memory 25 which can be controlled by means of the storey call transmitter 26, a device 27 which stores the operating state Z of the momentary cabin, a cost storage or memory 28, two cost portion or constituent storages 29, 30 and an allocation storage 31. The cabin call storage 20, the storey call storage 25, the cost storage 28 and the cost portion storages 29, 30 are connected with a scanner 32. The cost storage 29 additionally is operatively connected with a second scanner 33 connected with the allocation storage 31.

The storages or memories 20, 23, 24, 25 and 27 to 31 are random access memories which are connected by means of an external system bus or bus bar 34 with a microprocessor 35. The microprocessors 35 correlated to the individual elevators of the group are connected with a common line 36 by means of which for instance all of the storey call storages 25 can be connected with one another.

The scanners 32, 33 are storage locations or registers which contain addresses corresponding to the storey numbers, which are newly formed in each case by incrementizing during the scanning of the stories in the upward direction or deincrementizing during scanning in the downward direction. Each storey is provided with two scanner positions, with the exception of the end floors which only each possess one respective scanner position.

In the cost storage 28 there are stored for each position of the first scanner 32 the presumably arising loss times of the passengers, hereinafter referred to as the servicing costs K, as computated by the microprocessor 35. The loss times arising at a future halt at a considered storey for the passengers presumably located in the cabin are designated as the internal servicing costs $K_I$ and the loss times of the passengers presumably waiting at the considered storey and caused by the travel time of the cabin and the intermediate stops, has been designated as the external servicing costs $K_A$. The internal servicing costs determined by the following relationship $$K_1=t_v(P_M+k_1.R_E-k_2.R_C)$$

as well as the external servicing costs determined according to the equation $$K_A = k_1[m.t_m + t_v(R_E + R_C - R_{EC} + Z)]$$

are separately stored in the cost portion storages 29, 30. The total servicing costs K stored in the cost storage 28, which consitute a measure for the servicing capability of a cabin N of the group with respect to a real or fictitious storey call of the momentary scanner position n, can be computated according to the following relationship $$K_{N_n} = K_I + K_A = t_v(P_M + k_1.R_E - k_2.R_C) + k_1[m.t_m. + t_v(R_E + R_C - R_{EC} + Z)]$$

wherein in the preceding equation the following terms have the following meaning:

$t_v$ represents the delay time during an intermediate stop, $P_M$ the momentary load at the point in time of the computation, $R_E$ the number of allocated storey calls between the selector position and scanner position n, $R_C$ the number of cabin calls between the selector and scanner position n, $k_1$ an expected number of entering persons per storey call determined as a function of the traffic conditions, $k_2$ an expected number of exiting persons per cabin call determined as a function of the traffic conditions, m the number of storey distances between selector and scanner position n, $t_m$ the mean travel time per storey distance, $R_{EC}$ the number of coincidence of cabin calls and allocated storey calls between selector and scanner position, and Z an addition depending upon the operating state of the cabin.

The expected number of entering individuals $k_1$ per storey is statistically derived from the number of entering passengers in the past, specifically in such a manner that there is determined in each case from the load difference $\Delta L$ stored in the load storage 23 and determined at a storey call during a stop and the load difference $\Delta L'$ of the preceding stop the arithmetic mean, so that $k_1 = \frac{1}{2}(\Delta L + \Delta L')$. The expected number of exiting passengers $k_2$ per cabin call is computed by dividing the momentary cabin load $P_M$ by a number $R_C'$ of all cabin calls located in the direction of travel of the cabin.

In the allocation storage 31 of a cabin there are stored allocation instructions which in each case characterize that storey which is optimumly correlated to the relevant cabin. The storage of an allocation instruction is accomplished always then when the servicing costs K contained in the cost storage 28 of the same cabin are less than those of the remaining elevator cabins. The cost comparison is accomplished during each position of the second scanner 33 by means of a comparison device 37 which is operatively connected with the cost and allocation storages 28, 31 of the relevant cabins A, B, C. As the comparison device or comparator 37 there can be used for instance a device as known in the control which is part of the state of the art and described in the aforementioned U.S. Pat. No. 3,511,342 to which reference may be readily had and the disclosure of which is incorporated herein by reference.

Reference character 38 designates a selector connected with the storey call storage 25 and the cabin call storage 20, which indicates during cabin travel that storey at which the elevator cabin can stop in the presence of a stop or halt command. The selector 38 is a storage location or register containing an address, wherein the address correlated to the stories or floors are formed, depending upon the travel direction, by incrementizing or deincrementizing. A stop command always is then produced in a stop initiation device of a not here further explained drive control which is partially integrated in the previously described microprocessor system, when the selector 38 indicates a storey for which there has been stored a call and the cabin has attained a certain velocity threshold. If until reaching the velocity threshold there has not arrived any call, then the selector 38 is indexed or switched further through one storey.

The input-output components needed for the input of the storey and cabin calls, the load values and the operating state Z of the cabin as well as the external components which signal the momentary operating state Z, such as for instance "opening door", "closing door" or "cabin in travel mode" have not been shown. It should be understood that both the previously mentioned data as well as also the servicing costs and the allocation instructions, as required for digital computation systems, can be processed in the form of multi-bit words of the binary number system. In the embodiment illustrated in FIG. 1 the allocation instructions as well as the storey calls have been symbolically designated by "1", non-present allocation instructions and storey calls accordingly by the symbol "O".

The previously described group control functions in the following manner:

Upon occurrence of an event effecting a certain elevator of the group, such as for instance input of a cabin call, allocation of a storey call or change of the selector position, the first scanner 32 correlated to such elevator beings to revolve, referred to hereinafter as the cost computation cycle KBZ, starting from the selector position in the direction of travel of the cabin. As a result for each scanner position there is accomplished the computation of the servicing costs $$K = t_v(P_M + k_1.R_E - k_2.R_C) + k_1[m.t_n + t_v(R_E + R_C. - R_{EC} + Z)].$$

The control programme needed for this purpose is stored in a not particularly illustrated but conventional programmable read only memory connected by means of the external system bus bar or bus 34 with the microprocessor 35. After the start of the control programme there is accomplished in the microprocessor 35 the counting of the cabin calls $R_C$ located between the storage places (storey calls 3 and 9, FIG. 1) addressed by the first scanner 32 and selector 38 and that storey call $R_E$ for which there are stored allocation instructions (stories 4 and 6, FIG. 1) in the allocation storage 31, as well as the determination of the coincidence $R_{EC}$ of such cabin and storey calls $R_C$, $R_E$. With opposite direction of travel of the scanner 32 and selector 38 there are only counted in each case those cabin calls $R_C$ which are located between the storage place addressed by the selector 38 and the end storey located in the direction of travel. Furthermore, there are counted the storey distances m located between these addresses, wherein with opposite travel direction of the scanner 32 and selector 38 and presence of a direction call the reversal point of the counting direction is the relevant end storey. If no direction call is stored, then the number direction reversal point corresponds to the furthest present cabin call or allocated opposite direction call. Furthermore, there is accomplished the recall of the data $P_M$,ΔL,ΔL', Z and $R_C'$ from the storages or memories 23, 24, 27 present at the computation time point, computation of the factors $K_1$, $K_2$, and finally, while taking into account the constants $t_v$, $t_m$ stored in the read only memory, the formation of the internal and external servicing costs $K_I$, $K_A$ and their separate storage in the cost portion storages 29, 30 as well as the formation of the entire servicing costs K and storage thereof in the storage place or location of the cost storage 28 addressed by the first scanner 32. When forming the entire servicing costs K with a position of the first scanner 32 indicating a cabin call there are only taken into account the external servicing costs $K_A$, since the time loss of the passengers located in the elevator cabin cannot be ascribed to a storey call present in this considered scanner position, rather would arise anyway. After the storage of the entire servicing costs K there is accomplished formation of the address of the next scanner position and repetition of the previously described operations.

The computation of the servicing costs K is carried out recursively, wherein in each case resort is had to the results of the preceding scanner position and there is only taken into account the changes in the data which have arisen in the meantime.

During a revolution of the second scanner 33 which is accomplished simultaneously at all elevators, hereinafter briefly referred to as the cost comparison cycle KVZ, the servicing costs K contained in the cost storages or memories 28, are infed during each scanning position to the comparison device or comparitor 37 and the comparison operation is carried out, wherein in each case there is stored in the allocation storage 31 of that elevator an allocation instruction whose cost storage 28 has the lowest servicing costs K.

If the internal servicing costs $K_I$ contained in the cost proportion storages 29 of all elevators exceeds a certain threshold or limit at a considered scanner position, then there occurs a traffic saturation of the elevator group. This means that a storey call present at such scanner position cannot be serviced, since the threshold value of the inner servicing costs $K_I$ almost corresponds to the expected arising full load condition of the cabins. In this case the storey call is infed to a not here further described waiting list in the form of a storage device or memory from which, following elimination of the saturation while taking into account further there present storey calls such are again recalled in the timewise sequence of their inputing.

Figure 2:
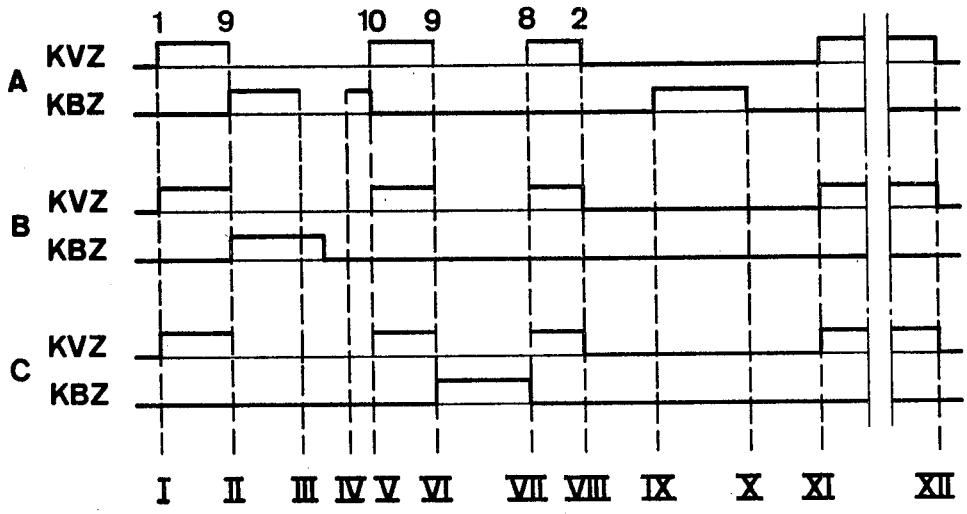
FIG. 2 is a diagram showing the time course of the control.

Based upon the showing of FIG. 2 there will be explained hereinafter the timewise course of the control:

The elevator group consisting in the exemplary embodiment of three elevators is capable of servicing thirteen stories or floors of a building, and thus, has twenty-four scanner positions. At time I the second scanners 33 begin with a cost comparison cycle KVZ in the storey 1 in upward direction, wherein the start is accomplished time-dependent, for instance five to twenty times per second. Based upon the comparison at the scanner position 9 (time point II) there can be accomplished a new allocation by extinguishing an allocation instruction at the elevator A and writing in an instruction at the elevator B. Since according to the example for the storey or landing 9 there is stored a storey call and the selector 38 indicates such storey or floor (FIG. 1), it would be possible to initiate the stop or halt command at the elevator B. Due to this new allocation there will be started for the elevators A, B a respective new cost computation cycle KBZ and the cost comparison cycle KVZ will be interrupted, since the first has priority. During the cost computation cycled KBZ of the elevator B is carried out without any interruption, that of the elevator A might not come into play between the time points III and IV due to a drive interruption. Thereafter the cost comparison is continued starting with the scanner position 10 (time V), in order to again be interrupted (time VI) during the scanner position 9 (downward) upon occurrence of an event at the elevator C, for instance change of the selector position. After completion of the thus triggered cost computation cycle KBZ at the elevator C (time VII) there is accomplished continuation of the cost comparison cycle KVZ and its termination at the scanner position 2 (downwards) (time VIII). Between the times, IX and X there occurs a further cost computation cycle KBZ for the elevator A, for instance triggered by a cabin call. The next cost comparison cycle KVZ started at the time XI then proceeds without interruption and is completed at the time XII.

Figure 3:
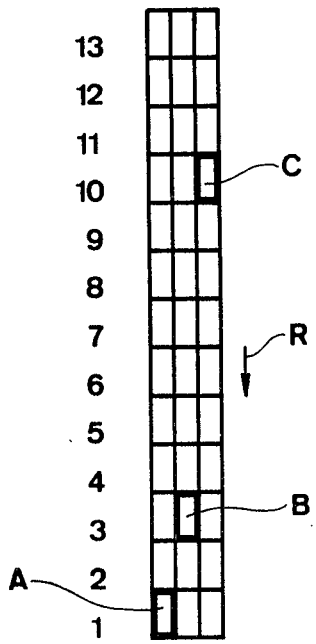
FIGS. 3, 4 and 5 respectively schematically illustrate the elevator group with different allocation examples.

In FIG. 3 there are stationed at the stories or floors 1, 3 and 10 the elevator cabins A, B and C which are stationary. Upon occurrence of a call R at the storey or floor 6 this call is allocated to the cabin B, since in relation to the scanner position corresponding to such call it has the shortest distance, and thus, also the lowest servicing costs K.

Figure 4:
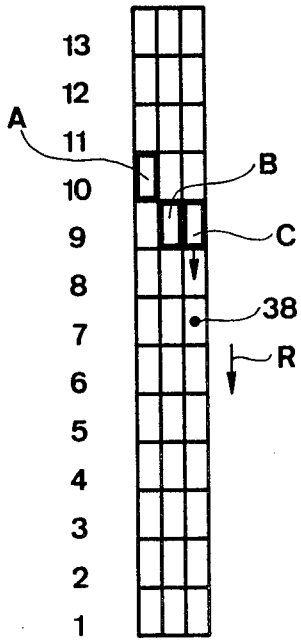

In FIG. 4 the cabins A and B are stationarily located at the stories or floors 10 and 9. The cabin C located likewise at the storey or floor 9 is about to travel downwards, and the selector 38 tends to indicate the storey 7. Upon occurrence of a downward call R at the storey 6 this call is allocated to the elevator cabin C, since the selector position which is decisive for the momentary cabin site in relation to the scanner position corresponding to the call has the lowest servicing costs K.

Figure 5:
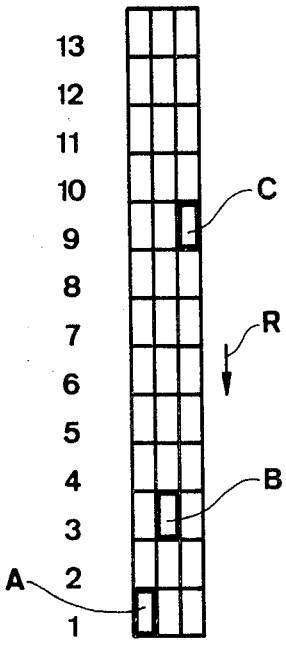

In FIG. 5 the elevator cabins A, B and C which are stationary are stationed at the stories or floors 1, 3 and 9. The elevator cabins B and C have the same servicing costs K in relation to the storey or floor 6. Now if there is inputted at such storey a call R, then this call is allocated to the cabin B, since a priority rule determines that, for instance, in each case the cabin preceeding the marking or characterizing sign has priority.

Instead of the construction proposed according to the exemplary embodiment, it would be possible to realize also with other means the group control of the invention. Thus, for instance, for the computer device there could be employed analogue computer elements, wherein for the storey calls allocated to the number $R_E$ and the devices counting the number $R_C$ of the cabin calls such could be constructed as an operational amplifier connected as a voltage follower, and for the subtractor there could be employed a differential amplifier. The scanner devices 32, 33 and the selector 38 can be mechanical or also electronic stepping mechanisms. The comparison device or comparator 37 can consist of comparators correlated to each elevator and constructed in the form of operational amplifiers functioning as switches, wherein their inputs are connected with the computer device and their outputs with allocation storages, which for each scanner position possess a respective storage cell in the form of a bistable multivibrator.

The inventive group control i.e. control for plural elevators, also can be employed for the horizontal conveying of personnel with an overtaking possibility.

While there are shown and described present preferred embodiments of the invention, it is to be distinctly understood that the invention is not limited thereto, but may be otherwise variously embodied and practiced with the scope of the following claims. ACCORDINGLY,

What we claim is:

1. In a group control for elevators each having an elevator cabin and containing at least one storey call storage controllable by means of a storey call transmitter, cabin call storages for controlling by means of cabin call transmitters each cabin of the group, selectors operatively correlated with each elevator of the group indicating that storey at which the cabin still could stop, load measuring devices operatively correlated with each elevator cabin, a scanner device having at least one position for each storey, wherein each elevator is provided with a computer device possessing an adder which forms at least the distance between a considered storey and the selector position, the number of intermediate stops to be expected within such distance based upon the prevailing cabin and allocated storey calls as well as the momentary cabin load, a time-proportional sum corresponding to the servicing capability of a cabin of the group with respect to the considered storey, and at least one comparison device by means of which the cabin having the lowest servicing costs corresponding to the smallest previously computated loss time and therefore the optimum servicing capability can be allocated to the considered storey, the improvement which comprises:

each elevator being provided with a computer device for counting the number of allocated storey calls and one of a number of cabin calls between a selector position and the considered storey;

each elevator further being provided with a device which stores the momentary operating state of the elevator cabins;

the computer device being provided with a subtractor unit for forming a difference from the number of said allocated storey calls multiplied by a number of passengers expected to enter the elevator cabin and the number of cabin calls multiplied by a number of passengers expected to exit from the elevator cabin;

said difference and a momentary operating state of the elevator cabin being infeedable as a further summand to the adder of the computer device;

the scanner device being connected with the computer device which for each position of the scanner device forms the sum corresponding to the servicing costs of a cabin with respect to a real or imaginary storey call of such position;

a storage device connected with the computer device and the scanner device;

said storage device can be filled by means of said scanner device; and said storage device receiving the correlations of the momentarily most optimumly employable cabin having the lowest servicing costs for the relevant position of the scanner device.

2. The group control for elevators as defined in claim 1, wherein:

the storage device containing the optimum correlation of the cabin and scanner position for each elevator contains a cost storage which can be filled during a revolution of a first scanner of the scanner device;

the storage device further containing an allocation storage which can be filled during a revolution of a second scanner of the scanner device;

the servicing costs computated during each scanner position being stored in the cost storages; and in the allocation storages there can be stored the allocation instructions corresponding to the optimum correlations.

3. The group control for elevators as defined in claim 1, wherein:

the determination of the servicing costs in passenger seconds is accomplished by the computer device for a random cabin of the elevator group during each scanner position in accordance with the following equation:

$$K_{N_n}=t_v(P_M+k_1.R_E-k_2.R_C)+k_1[m.t_m+t_v.(R_E+R_C-R_{EC}+Z)],$$

wherein:

$t_v$ represents the delay time during an intermediate stop, $P_M$ represents the momentary load at the point in time of computation, $R_E$ represents the number of allocated storey calls between the selector and scanner position n, $R_C$ represents the number of cabin calls between the selector and scanner position n, $k_1$ represents a contemplated number, determined as a function of the traffic conditions, of persons entering the cabin per storey call, $k_2$ represents a contemplated number, determined as a function of the traffic conditions, of exiting passengers per cabin call, m represents the number of storey distances between the selector and scanner position n, $t_m$ represents the mean travel time per storey distance, $R_{EC}$ represents the number of coincidences of cabin calls and allocated storey calls between selector and scanner position, Z represents an addition dependent upon the operating state of the cabin, $t_v(P_M+k_1.R_E-k_2.R_C)$ represents the loss times of internal servicing costs ($K_I$) corresponding to passengers who apparently will be located in the cabin, which costs can arise during a stop at a storey designated by the scanner position n, and $k_1[m.t_m+t_v(R_E+R_C-R_{EC}+Z)]$ represents the loss times of contemplated waiting passengers in a storey designated by the scanner position n corresponding to the external servicing costs ($K_A$).

4. The group control for elevators according to claim 2, further including:

a load storage in which there can be stored the cabin load determined in the related load measuring device and the load differences determined during each stop at a storey call; and the contemplated number of entering passengers being determined at each stop at a storey call from the load differences of the momentary and preceding computated arithmetic means $\frac{1}{2}(\Delta L+\Delta L')$.

5. The group control for elevators as defined in claim 2, further including:

a device for counting and storing the number of cabin calls present in the cabin call storage and all located in the direction of travel of the cabin; and the contemplated number of exiting passengers being computed by dividing the momentary cabin load by the number of all cabin calls located in the direction of travel of the cabin.

6. The group control for elevators as defined in claim 1, wherein:

said computer device comprises at least one microprocessor.

7. The group control for elevators as defined in claim 1, wherein:

said elevator is provided with a storey call storage in the form of an addressable random access memory which can be addressed by means of a first scanner of the scanner device and the selector;

each storey call storage being connected by means of external system bus bar with a microprocessor of the related computer device; and all storey call storages being connected with one another by a common line correlated to all of the microprocessors.

8. The group control for elevators as defined in claim 1 or 2, wherein:

the cost and allocation storages are connected with the comparison device;

the comparison of the servicing cost being accomplished for each scanner position during a revolution of the second scanner; and an allocation instruction being writable into the allocation storage of the elevator cabin possessing the lowest servicing costs.

9. The group control for elevators according to claims 1 or 2, wherein:

the cabin call storage comprises a random access memory which can be addressed by means of the first scanner and the selector;

the cost storage comprises a random access memory which can be addressed by means of the first and the second scanners;

the allocation storage comprises a random access memory which can be addressed by means of the second scanner; and said random access memories being connectable by means of an external system bus bar with a microprocessor of the computer device determining the number of storey call distances between the storage places addressed by the first scanner and the selector, the number of cabin calls and that number of storey calls for which there is provided an allocation instruction in the allocation storage, and between whose storage places there are counted the number of calls as well as the number of coincidences of such calls.

10. The group control for elevators as defined in claim 2 or 3, further including:

a respective cost portion storage operatively associated with the cost storage and storing the internal servicing costs and the external servicing costs of all stories;

said cost portion storages comprising random access memories which can be addressed by the first scanner; and wherein with a position of the first scanner exhibiting a cabin call there is exclusively recallable the external operating costs out of the related cost portion storage and such can be written into the cost storage.

11. The group control for elevators as defined in claim 1, wherein:

the device storing the operating state of the cabins comprises a random access memory; and said random access memory being connected with external input components signalling the momentary operating state and the microprocessor of the computer device.

12. The group control for elevators as defined in claim 5, wherein:

the device counting and storing the number of all cabin calls located in the direction of travel comprises a random access memory connected with the microprocessor of the computer device.

13. The group control for elevators as defined in claim 4, wherein:

said load storage comprises a random access memory which is connected by means of an external input component with the load measuring device; and said random access memory being connected with the microprocessor of the computer device.

14. The group control for elevators as defined in claim 2, wherein:

the first scanner, the second scanner and the selector comprise storage locations or registers containing addresses;

the first scanner following the computation of the total servicing costs for a storey and the second scanner following the comparison of the total servicing costs of said storey being capable of being incrementized or deincrementized; and the selector being capable of being travel-dependent incrementizable or deincrementizable.

15. The group control for elevators as defined in claim 10, further including:

a waiting list in the form of a storage device in which there can be stored those storey calls in a timewise sequence and excludable from the allocation for which the internal servicing costs contained in the cost portion storages of all elevators exceed a threshold value defining a saturation state; and after elimination of such saturation state the storey calls can be individually recalled out of the wating list in the timewise sequence of their inputting.

16. The group control for elevators as defined in claim 1 or 2, further including:

a device for generating a fictitious storey call by means of which unoccupied cabins, whose allocation storage contains an allocation instruction for the fictitious storey call, can be called to at least one parking storey.

* * * * *